US009296954B2

(12) United States Patent
Yuan et al.

(10) Patent No.: US 9,296,954 B2
(45) Date of Patent: Mar. 29, 2016

(54) TREATMENT OF POOR PROCESSING BITUMEN FROTH USING SUPERCRITICAL FLUID EXTRACTION

(71) Applicant: SYNCRUDE CANADA LTD. in trust for the owners of the Syncrude Project, Fort McMurray (CA)

(72) Inventors: Simon Yuan, Edmonton (CA); Brent Hilscher, Surrey (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 203 days.

(21) Appl. No.: 13/900,390

(22) Filed: May 22, 2013

(65) Prior Publication Data

US 2014/0346088 A1 Nov. 27, 2014

(51) Int. Cl.
*C10G 1/04* (2006.01)
*C10G 33/06* (2006.01)

(52) U.S. Cl.
CPC ..... *C10G 1/045* (2013.01); *C10G 1/047* (2013.01); *C10G 33/06* (2013.01)

(58) Field of Classification Search
CPC ..... C10G 1/04
See application file for complete search history.

(56) References Cited

U.S. PATENT DOCUMENTS

| | | | |
|---|---|---|---|
| 3,993,555 | A | 11/1976 | Park et al. |
| 4,007,785 | A | 2/1977 | Allen et al. |
| 4,035,282 | A | 7/1977 | Stuchberry et al. |
| 4,036,732 | A | 7/1977 | Irani et al. |
| 4,067,796 | A | 1/1978 | Alford et al. |
| 4,109,720 | A | 8/1978 | Allen et al. |
| 4,120,775 | A | 10/1978 | Murray et al. |
| 4,139,450 | A | 2/1979 | Hanson et al. |
| 4,160,718 | A | 7/1979 | Rendall |
| 4,217,956 | A | 8/1980 | Goss et al. |
| 4,347,118 | A | 8/1982 | Funk et al. |
| 4,373,267 | A | 2/1983 | Lycan |
| 4,376,693 | A | 3/1983 | Warzel |
| 4,396,498 | A | 8/1983 | Dente et al. |
| 4,422,901 | A | 12/1983 | Karnofsky |
| 4,424,112 | A | 1/1984 | Rendall |
| 4,448,667 | A | 5/1984 | Karnofsky |
| 4,457,827 | A | 7/1984 | Chung et al. |
| 4,512,872 | A | 4/1985 | Chung et al. |
| 4,532,024 | A | 7/1985 | Haschke et al. |
| 4,557,820 | A | 12/1985 | Paspek, Jr. et al. |
| 4,559,127 | A | 12/1985 | Paspek, Jr. |
| 4,588,476 | A | 5/1986 | Warzel |
| 4,675,097 | A | 6/1987 | Patel et al. |
| 4,676,889 | A | 6/1987 | Hsieh et al. |
| 4,704,200 | A | 11/1987 | Keane |
| 4,722,782 | A | 2/1988 | Graham et al. |
| 4,859,317 | A | 8/1989 | Shelfantook et al. |
| 4,875,998 | A | 10/1989 | Rendall |
| 4,968,412 | A | 11/1990 | Guymon |
| 5,056,596 | A | 10/1991 | McKay et al. |
| 5,122,259 | A | 6/1992 | Nielson |
| 5,178,733 | A | 1/1993 | Nielson |
| 5,236,577 | A | 8/1993 | Tipman et al. |
| 5,322,617 | A | 6/1994 | de Bruijn et al. |
| 5,534,136 | A | 7/1996 | Rosenbloom |
| 5,899,274 | A | 5/1999 | Frauenfeld et al. |
| 5,911,541 | A | 6/1999 | Johnson |
| 5,985,138 | A | 11/1999 | Humphreys |
| 6,019,888 | A | 2/2000 | Mishra et al. |
| 6,068,758 | A | 5/2000 | Strausz |
| 6,464,856 | B1 | 10/2002 | Di Tullio |
| 6,576,145 | B2 | 6/2003 | Conaway et al. |
| 6,883,607 | B2 | 4/2005 | Nenniger et al. |
| 7,357,857 | B2 | 4/2008 | Hart et al. |
| 7,363,973 | B2 | 4/2008 | Nenniger et al. |
| 7,381,320 | B2 | 6/2008 | Iqbal et al. |
| 7,628,909 | B2 | 12/2009 | Cobb |
| 7,694,736 | B2 | 4/2010 | Tsilevich |
| 7,699,104 | B2 | 4/2010 | Tsilevich |
| 7,722,759 | B2 | 5/2010 | Duke et al. |
| 2011/0049016 | A1 | 3/2011 | McGrady et al. |

FOREIGN PATENT DOCUMENTS

| | | |
|---|---|---|
| CA | 2746987 | 1/2012 |

OTHER PUBLICATIONS

A. Chakma, Supercritical Extraction of Tar Sands Bitumen, 7 Rev. High Pressure Sci. Technol. 1389-1394 (1998).*

L.S. Kotlyar et al., Supercritical Fluid Extraction of Bitumen Free Solids Separated From Athabasca Oil Sand Feed and Hot Water Process Tailings Pond Sludge, 8 Fuel Sci. Technol. Int. 871-879 (1990).*

M.D. Deo et al., Supercritical Fluid Extraction of a Crude Oil, Bitumen-Derived Liquid and Bitumen by Carbon Dioxide and Propane, 71 Fuel 1519-1526 (1992).*

Salim, P.H., et al. A Generalized Equation of State Approach to the Prediction of Phase Behavior in CO2-Bitumen Systems. The Journal of Supercritical Fluids. 1995. pp. 6-14. vol. 8(1).

Watanabe, M. et al. Heavy Oil Upgrading in the Presence of High Density Water; Basic Study. The Journal of Supercritical Fluids. 2010. pp. 48-52. vol. 53(1-3).

Morimoto, M. et al. Effect of Supercritical Water on Upgrading Reaction of Oil Sand Bitumen. The Journal of Supercritical Fluids. 2010. pp. 223-231. vol. 55(1).

(Continued)

*Primary Examiner* — Randy Boyer
(74) *Attorney, Agent, or Firm* — Bennett Jones LLP

(57) ABSTRACT

A method for extracting hydrocarbons from a poor processing bitumen froth is provided comprising subjecting a bitumen, solids and water slurry to flotation in a flotation device to produce the poor processing bitumen froth; optionally subjecting the poor processing bitumen froth to centrifugation to remove a portion of the water from the poor processing bitumen froth; and subjecting the poor processing bitumen froth to supercritical extraction in a pressure vessel using a supercritical fluid to produce a hydrocarbon stream suitable for further upgrading.

12 Claims, 1 Drawing Sheet

(56) References Cited

OTHER PUBLICATIONS

Sato, T. et al. Upgrading of Bitumen with Formic Acid in Supercritical Water. The Journal of Supercritical Fluids. 2010. pp. 232-240. vol. 55(1).
Zhao, S., et al. Correlation of Processability and Reactivity Data for Residua From Bitumen, Heavy Oils and Conventional Crudes: Characterization of Fractions from Super-critical Pentane Separation as a Guide to Process Selection. Catalysis Today. 2007. pp. 122-136. vol. 125(3-4).
Junaid, A.S.M., et al. Natural Zeolite Catalyzed Cracking-Assisted Light Hydrocarbon Extraction of Bitumen From Athabasca Oilsands. Applied Catalysis A: General. 2009. pp. 44-49. vol. 354 (1-2).
Price, L.C., et al. Solubility of Crude Oil in Methane as a Function of Pressure and Temperature. Organic Geochemistry. 1983. pp. 201-221. vol. 4(3-4).
Kuangzong, Q. Thermal Depolymerization of Kerogen and Formation of Immature Oil. Organic Geochemistry. 1988. pp. 1045-1050. vol. 13(4-6).
Meadus, F.W., et al. Solvent Extraction of Athabasca Oil—Sand in a Rotating Mill Part 1. Dissolution of Bitumen. Fuel Processing Technology. 1982. pp. 277-287. vol. 6(3).
Berkowitz, N., et al. Extraction of Oil Sand Bitumens with Supercritical Water. Fuel Processing Technology. 1990. pp. 33-44 vol. 25(1).
Hu, H., et al. Kinetic Study of Supercritical Extraction of Oil Shales. Fuel Processing Technology. 1992. pp. 72-90. vol. 31(2).
Deo, M.D., et al. The Effect of Cosolubilizing Lighter Components on the Asphaltene Content of Heavy Oils. Fuel Processing Technology. 1993. pp. 217-228. vol. 34(3).
Subramanian, M., et al. Supercritical Fluid Extraction of Bitumens From Utah Oil Sands. Fuel Processing Technology. 1998. pp. 35-53. vol. 55(1).
Zhao, Y., et al. Simultaneous Removal of Asphaltenes and Water From Water-in-Bitumen Emulsion: I. Fundamental Development. Fuel Processing Technology. 2008. pp. 933-940. vol. 89(10).
Zhao, Y., et al. Simultaneous Removal of Asphaltenes and Water from Water-in-Bitumen Emulsion: II. Application Feasibility. Fuel Processing Technology. 2008. pp. 941-948. vol. 89(10).
Patwardhan, S.R. Fractionation of Petroleum Bitumens. Fuel. 1977. pp. 40-44. vol. 56(1).
Moy, E., et al. Study of Particles in solvent Extracted Bitumen by Image analysis. Fuel. 1989. pp. 341-345. vol. 68(3).
Deo, M.D., et al. Supercritical Fluid Extraction of a Crude Oil, Bitumen-Derived Liquid and Bitumen by Carbon Dioxide and Propane. Fuel. 1992. pp. 1519-1526. vol. 71(12).
Deo, M.D., et al. Asphaltene Rejection via Supercritical Fluid Extraction. Fuel. 1994. pp. 1493-1498. vol. 73(9).
Dai, Q., et al. Bitumen-Sand Interaction in Oil Sand Processing. Fuel. 1995. pp. 1858-1864. vol. 74(12).
Scott, D.S., et al. Upgrading of Bitumen in Supercritical Fluids. Fuel. 2001. pp. 1087-1099. vol. 80(8).
Rose, J.L., et al. Exprimental Data for the Extraction of Peace River Bitumen Using Supercritical Ethane. Fuel. 2001. pp. 1101-1110. vol. 80(8).
Zhao, S., et al. Molecular Transformation of Athabasca Bitumen End-Cuts During Coking and Hydrocracking. Fuel. 2001. pp. 1155-1163. vol. 80(8).
Long, Y., et al. Stability and Settling Characteristics of Solvent-Diluted Bitumen Emulsions. Fuel. 2002. pp. 1945-1952 vol. 15(1).
Dehkissia, S., et al. Catalytic (Mo) Upgrading of Athabasca Bitumen Vacuum Bottoms Via Two-Step Hydrocracking and Enhancement of Mo-Heavy Oil Interaction. Fuel. 2004. pp. 1323-1331. vol. 83(10).
Zhao, S., et al. Systematic Characterization Petroleum Residua Based on SFEF. Fuel. 2005. pp. 635-645. vol. 84(6).
G-Hourcade, M.L., et al. Study of the Solubility of Kerogen From Oil Shales (Puertollano, Spain) in Supercritical Toluene and Methanol. Fuel. 2007. pp. 698-705. vol. 66(5-6).
Kariznovi, M., et al. Experimental Apparatus for Phase Behavior Study of Solvent-Bitumen Systems: A Critical Review and Design of a New Apparatus. Fuel. 2011 pp. 536-546. vol. 90(2).
Das, S.K., et al. Mechanism of the Vapor Extraction Process for Heavy Oil and Bitumen. Journal of Petroleum Science and Engineering. 1998. pp. 43-59. vol. 21(1-2).
Peramanu, S., et al. Flow Loop Apparatus to Study the Effect of Solvent, Temperature and Additives on Asphaltene Precipitation. Journal of Petroleum Science and Engineering. 1999. pp. 133-143, vol. 23(2).
Sparks, B.D., et al. Athabasca Oil Sands; Effect of Organic Coated Solids on Bitumen Recovery and Quality. Journal of Petroleum Science and Engineering. 2003 pp. 417-430. vol. 39(3-4).
Kapadia, R.A., et al. Determination of Gas Dispersion in Vapor Extraction of Heavy Oil and Bitumen. Journal of Petroleum Science and Engineering. 2006. pp. 214-222. vol. 51(3-4).
El-Haj, R., et al. Experimental Determination of Butane Dispersion in Vapor Extraction of Heavy Oil and Bitumen, Journal of Petroleum Science and Engineering. 2009. pp. 41-47. vol. 67 (1-2).
Yu, J.M., et al. Phase Behavior of Reservior Fluids. Supercritical Carbon Dioxide and Cold Lake Bitumen. Fluid Phase Equilibria. 1989. pp. 429-438. vol. 53.
Huang, S.H., et al. Phase Behavior of Reservoir Fluids II: Supercritical Carbon Dioxide and Bitumen Fractions. Fluid Phase Equilibria. 1990. pp. 81-98. vol. 60(1-2).
Jamaluddin, A.K.M., et al. Predictions of CO2 Solubility and CO2 Saturated Liquid Density of Heavy Oils and Bitumens Using a Cubic Equation of State. Fluid Phase Equilibria. 1991. pp. 33-48. vol. 64.
Huang, S.H., et al. Phase Behavior of Reservoir Fluids III: Molecular Lumping and Characterization. Fluid Phase Equilibria. 1991. pp. 1-21. vol. 66(1-2).
Huang, S.H., et al. Phase Behavior of Reservoir Fluids IV: Molecular Weight Distributions for Thermodynamic Modeling. Fluid Phase Equilibria. 1991. pp. 23-40. vol. 66(1-2).
Yu, J.M., et al. Phase Behavior of Reservoir Fluids: VI. Cosolvent Effects on Bitumen Fractionation with Supercritical CO2. Fluid Phase Equilibria. 1994. pp. 353-362. vol. 93.
Han, B., et al. Phase Equilibria of Supercritical Propane-Fengcheng Bitumen System and the Density and Viscosity of the Liquid Phase. Fluid Phase Equilibria. 1998. pp. 205-211. vol. 143(1-2).
Chakina, A. 99/01035 Supercritical Extraction of Tar Sands Bitumen: Koatsuryoku no Gijutsu, 1998, 7, (Proceedings of International Conference—MRAPT-16 and HPCJ-38—on High Pressure Science and Technology, 1997), 1389-1394. Fuel and Energy Abstracts. 1999. p. 108. vol. 40(2).

* cited by examiner

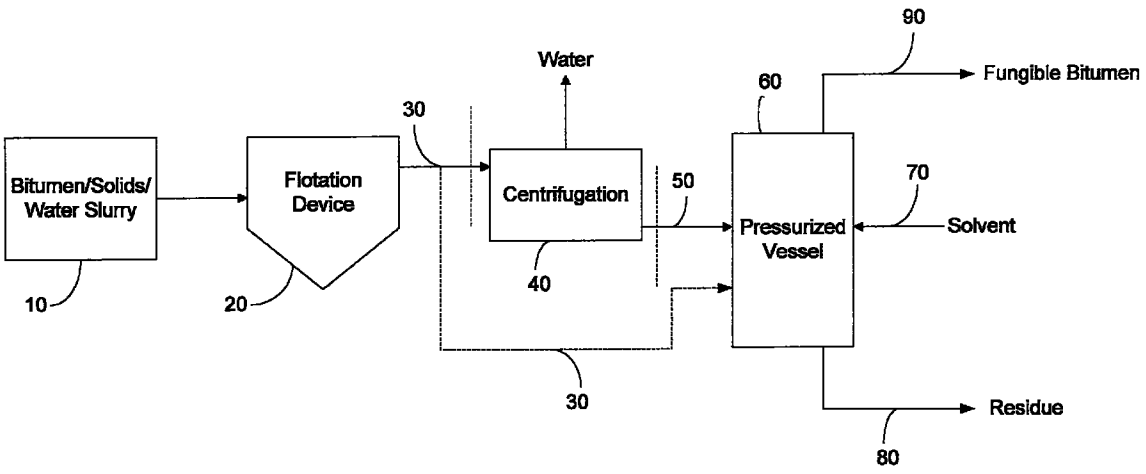
Bitumen/Solids/
Water Slurry
10
Flotation
Device
20
30
Centrifugation
40
Water
30
50
Pressurized
Vessel
60
70
Solvent
90
Fungible Bitumen
80
Residue

TREATMENT OF POOR PROCESSING BITUMEN FROTH USING SUPERCRITICAL FLUID EXTRACTION

FIELD OF THE INVENTION

The present invention relates to a method for treating poor processing bitumen froth. More particularly, supercritical fluid extraction is used to extract high quality (fungible) bitumen from poor processing bitumen froth, such as bitumen froth obtained from fluid fine tailings (FFT).

BACKGROUND OF THE INVENTION

Oil sand, as known in the Athabasca region of Alberta, Canada, comprises water-wet, coarse sand grains having flecks of a viscous hydrocarbon, known as bitumen, trapped between the sand grains. The water sheaths surrounding the sand grains contain very fine clay particles. Thus, a sample of oil sand, for example, might comprise 70% by weight sand, 14% fines, 5% water and 11% bitumen (all % values stated in this specification are to be understood to be % by weight).

For the past several decades, the bitumen in Athabasca oil sand has been commercially recovered using a water-based process. In the first step, the oil sand is slurried with process water, naturally entrained air and, optionally, caustic (NaOH). The slurry is mixed, for example in a tumbler or pipeline, for a prescribed retention time, to initiate a preliminary separation or dispersal of the bitumen and solids and to induce air bubbles to contact and aerate the bitumen. This step is referred to as "conditioning".

The conditioned slurry is then further diluted with flood water and introduced into a large, open-topped, conical-bottomed, cylindrical vessel (termed a primary separation vessel or "PSV"). The diluted slurry is retained in the PSV under quiescent conditions for a prescribed retention period. During this period, aerated bitumen rises and forms a froth layer, which overflows the top lip of the vessel and is conveyed away in a launder. Sand grains sink and are concentrated in the conical bottom. They leave the bottom of the vessel as a wet tailings stream containing a small amount of bitumen. Middlings, a watery mixture containing fine solids and bitumen, extend between the froth and sand layers.

The wet tailings and middlings are separately withdrawn, combined and sent to a secondary flotation process. This secondary flotation process is commonly carried out in a deep cone vessel wherein air is sparged into the vessel to assist with flotation. This vessel is referred to as the Tailings Oil Recovery (TOR) vessel. The bitumen recovered by flotation in the TOR vessel is recycled to the PSV. The middlings from the deep cone vessel, termed as flotation tailings are sent to tailings pond. The underflow from the deep cone vessel, i.e., the coarse tailings, is pumped through pipeline to the tailings deposition areas. In the alternative, a series of flotation cells can be used to recover the bitumen remaining in the wet tailings and/or middlings from the PSV.

The bitumen froths produced by the PSV are subjected to cleaning, to reduce water and solids contents so that the bitumen can be further upgraded. A typical bitumen froth obtained from the PSV comprises about 60-65 wt % bitumen, about 25-30 wt % water and about 10 wt % solids. There are currently two different types of PSV bitumen froth treatment processes which are used in the oil sands industry. One type of froth treatment process is the naphthenic process, which has been used commercially for several decades. The other type of froth treatment process is the paraffinic process, which has been developed more recently. Both types of froth treatment use a solvent to produce a diluted bitumen product (i.e., dilbit) which is diluted with the solvent.

More particularly, with respect to the naphthenic process, bitumen froth is diluted with the light hydrocarbon diluent, naphtha, to increase the difference in specific gravity between the bitumen and water and to reduce the bitumen viscosity, to thereby aid in the separation of the water and solids from the bitumen. This diluent diluted bitumen froth is commonly referred to as "dilfroth". It is desirable to "clean" dilfroth, as both the water and solids pose fouling and corrosion problems in upgrading refineries. By way of example, the composition of naphtha-diluted bitumen froth typically might have a naphtha/bitumen ratio of 0.65 and contain 20% water and 7% solids. It is desirable to reduce the water and solids content to below about 3% and about 1%, respectively, to make it amenable to further upgrading. Separation of the bitumen from water and solids may be done by treating the dilfroth in a sequence of scroll and disc centrifuges. Alternatively, the dilfroth may be subjected to gravity separation in a series of inclined plate separators ("IPS") in conjunction with countercurrent solvent extraction using added light hydrocarbon diluent.

In the paraffinic process, a paraffinic solvent is used to dilute the bitumen contained in the bitumen froth. A paraffinic solvent consists of or contains significant amounts of one or more relatively short-chained aliphatic compounds (such as, for example, C4 to C8 aliphatic compounds). Asphaltenes generally exhibit less solubility in paraffinic solvents than in naphtha solvents, and asphaltenes tend to exhibit greater solubility in longer chain paraffinic solvents than in shorter chain paraffinic solvents.

In the paraffinic process, the addition of the paraffinic solvent to the bitumen froth appears to destabilize the asphaltenes contained in the bitumen froth, some of which precipitate out as clusters or aggregates while simultaneously trapping maltenes, solid mineral material and water within the clusters and aggregates. The precipitation of asphaltenes therefore has the effect of separating solid mineral material and water from the bitumen, while the increased difference in specific gravity between the phases which results from the dilution of the bitumen (including both maltenes and unprecipitated asphaltenes) by the paraffinic solvent enhances the separation of the remaining solid mineral material and water from the diluted bitumen. Typically, the paraffinic process is performed in a manner so that between about 40 percent and about 50 percent by weight of the asphaltenes contained in the bitumen froth are precipitated in order to produce a diluted bitumen product which has a relatively low solids and water content.

However, when bitumen froths are obtained from more non-traditional sources, e.g., from oil sand tailings, fluid fine tailings, middlings, and the like, the composition of these froths are not amenable to conventional froth treatment processes. For example, a typical bitumen froth obtained from fluid fine tailings using flotation based technologies comprises about 10-20% bitumen, about 60-70 wt % water and about 20% solids. Therefore, there is a need for a froth treatment process that can be used to extract fungible bitumen from low grade bitumen froth.

SUMMARY OF THE INVENTION

The current application is directed to a froth treatment process that can be used to extract fungible bitumen from poor processing bitumen froth. It was surprisingly discovered that supercritical fluids could be used as solvents for extracting bitumen present in poor processing bitumen froths, which would result in a "clean" bitumen product that could be further upgraded to valuable products. As used herein, a "poor processing bitumen froth" generally means a froth obtained from secondary sources such as oil sand tailings, mature fine tailings, middlings and the like, which has a substantially lower wt % bitumen, higher wt % water and higher wt % solids than primary bitumen froth obtained from flotation of an oil sand slurry, for example, in a PVS. Typically, poor processing bitumen froth comprises about 10-30% bitumen, about 50-70 wt % water and about 20% solids or more.

A supercritical fluid is any substance at a temperature and pressure above its critical point, where distinct liquid and gas phases do not exist. Thus, it can effuse through solids like a gas and dissolve materials like a liquid. For example, supercritical $CO_2$ has been used in the coffee industry to remove caffeine from coffee beans. Every fluid has a unique pressure and temperature requirement to become supercritical. For $CO_2$, the minimum temperature and pressure is 32° C. (305K) and 7.4 Mpa (74 bar), respectively, to reach the supercritical state.

The present application uses a supercritical fluid as a solvent for extracting bitumen from bitumen froth, in particular, poor processing bitumen froth. In one embodiment, both the water and bitumen are dissolved into a supercritical fluid (solvent), leaving behind the solids as well as a portion of asphaltenes as a dry granular residue. The bitumen is then removed through one or more stages of pressure and/or temperature reduction. In one embodiment, bitumen can be removed in one stage or can be removed in two stages as light and heavy fractions. In one embodiment, water is removed in another stage. The solvent used in the process is condensed back into its original state for storage or are reheated and pressurized for immediate recycling.

In one embodiment, the solvent is selected from the group consisting of $CO_2$, pentane and hexane. In another embodiment, more than one solvent can be used, for example, pentane/hexane and $CO_2$.

In one aspect, a method of extracting bitumen from poor processing bitumen froth is provided, comprising:

- subjecting a bitumen, solids and water slurry to flotation in a flotation device to produce the poor processing bitumen froth;
- optionally subjecting the poor processing bitumen froth to centrifugation to remove a portion of the water from the poor processing bitumen froth; and
- subjecting the poor processing bitumen froth to supercritical extraction in a pressure vessel using a supercritical fluid to produce a hydrocarbon stream suitable for further upgrading.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the FIGURE, wherein:

FIG. 1 is a schematic showing, in general, one embodiment of a poor processing bitumen froth treatment process using supercritical fluid(s).

DETAILED DESCRIPTION OF THE PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a method of extracting bitumen from a poor processing bitumen froth using supercritical fluid(s). The poor processing bitumen froth can be obtained from a variety of sources, for example, from the tailings produced during conventional oil sands water-based bitumen extraction processes. In one embodiment, the tailings can be tailings produced during conventional PSV bitumen froth cleaning by naphthenic or paraffinic froth treatments. In another embodiment, fluid fine tailings, such as those found in tailings reservoirs, can be used.

FIG. 1 is a general schematic of a poor processing bitumen froth treatment process using supercritical extraction. A bitumen/water/solids slurry 10 (e.g., tailings), generally comprising about 0.1-5% bitumen with varying solids and water contents, is subjected to flotation in a flotation device 20 known in the industry. For example, the flotation device can be a stationary settling vessel, a flotation cell, and the like such as a flotation column and a Jameson cell. The poor processing bitumen froth produced from the flotation device generally contains about 10-20% bitumen, about 60-70 wt % water and about 20% solids. The bitumen froth 30 is removed and, optionally, the bitumen froth 30 can be further treated in a centrifuge 40, wherein some of the water is separated from the bitumen, as most of the bitumen appears to be adhered to the fine solids such as clays. This is particularly true when the feedstock used is fluid fine tailings.

After centrifugation, dewatered bitumen froth 50, which in some instances may be in the form of a paste, is introduced into a pressurized vessel 60. Solvent 70, such as $CO_2$, propane, pentane, hexane, and the like, or combinations thereof, is also introduced into the pressurized vessel. It is understood that bitumen froth 30 can be fed directly into the pressurized vessel to produce cleaned bitumen. Two separate streams were formed; a residue stream 80 comprising primarily clays and asphaltenes (or other coal-type hydrocarbons) and an extraction stream 90 comprising fungible bitumen.

Example 1

In the present example, packing is placed in a 100 ml 10,000 psi pressure vessel. The pressure vessel was pressurized to 9000 psi and the temperature was controlled to 100° C. In this example, $CO_2$ was used as the solvent. The extraction unit, in addition to the pressure vessel, further comprises a high pressure pump and a pre-heater for the carbon dioxide. The extracted material flows out of the pressure vessel and into a collection vessel.

In this example, the feedstock used was poor processing bitumen froth obtained from fluid fine tailings (also referred to as mature fine tailings) from an oil sand tailings pond using flotation based technologies. In this example, the bitumen froth was centrifuged to remove a portion of the water, which water contained very little bitumen. Most of the bitumen was found in the solid paste-like phase and this paste was used as the feedstock for the extraction unit. Centrifugation proved to be an effective means of reducing the volume of feed to the supercritical unit and also created a single phase feed. A single phase feed at full scale ensures that all feed has the same residence time and there is no short circuiting. Furthermore, volume reduction by a factor of 2 or 3 reduces the required supercritical equipment size and capital cost. The centrifuged paste-like feedstock (42.14 g) was forced between the spaces of the packing in the vessel and the flow of carbon dioxide was 4 L per minute.

In this example, primarily short chain hydrocarbons were removed (light bitumen). Recovery using $CO_2$ was approximately 30% of high quality oil.

Example 2

In this example, the aim was to extract both short and longer chained hydrocarbons from poor processing bitumen froth. The feedstock used was the same as Example 1. Pentane at 2000 or 5000 psi and 120° C. was used. The recovery calculations for the tests with pentane are shown in Table 1.

TABLE 1

Recovery Calculations for Tests with Pentane

| Test Conditions | Name | Mass (g) | Tag # | C (%) | H (%) | S (%) | N (%) | C (g) | H (g) | S (g) | N (g) |
|---|---|---|---|---|---|---|---|---|---|---|---|
| Pentane/2000 Psi/ | Feed | 29.07 | E97697 | 83.2 | 10.1 | 6.76 | 0.53 | 24.19 | 2.94 | 1.97 | 0.15 |
| 120° C. | Tail | 16.81 | E97695 | 45.8 | 4.96 | 4.24 | 0.6 | 7.19 | 0.83 | 0.71 | 0.10 |
| | | | | | | | F-T % Rec | 70% | 72% | 64% | 35% |
| Pentane/5000 Psi/ | Feed | 29.07 | E97697 | 83.2 | 10.1 | 6.76 | 0.53 | 24.19 | 2.945 | 1.9651 | 0.154 |
| 125° C. | Tail | 11.38 | E97694 | 35 | 2.87 | 4.21 | 0.5 | 3.983 | 0.327 | 0.4791 | 0.057 |
| | | | | | | | F-T % Rec | 84% | 89% | 76% | 63% |
| Pentane/5000 Psi/ | Feed | 29.07 | E97697 | 83.2 | 10.1 | 6.76 | 0.53 | 24.19 | 2.945 | 1.9651 | 0.154 |
| 120° C. | Tail | 11.89 | E97693 | 33.2 | 2.45 | 4.2 | 0.5 | 3.947 | 0.291 | 0.4994 | 0.059 |
| | | | | | | | F-T % Rec | 84% | 90% | 75% | 61% |

As shown in Table 1, the best test results were with 5000 psi pentane and 120° C. The tests were duplicated at 125° C. and the results matched very well. A carbon extraction of about 84% and a hydrogen extraction of about 90% indicated a bitumen recovery in excess of 90%. Residue assays showed 34% C and 2.7% H, which, based on the atomic weights of each, resulted in a one to one ratio. This suggests that most of the hydrocarbons left behind are in the less desirable form of asphaltenes and coal type hydrocarbons. Pentane at 120° C. and 2000 psi showed carbon extraction of about 70% and hydrogen extraction of about 72%, indicating a bitumen recovery in excess of 72% but significant losses of heavy hydrocarbons and hydrocarbons containing sulfur and nitrogen.

Product quality tests showed that solids contamination of the extracted hydrocarbons were at or below the detection limit. Thus, products from this process would be considered fungible bitumen that has less asphaltenes than typical bitumen obtained from conventional extraction processes.

Example 3

Experiments were repeated using $CO_2$ with hexane and/or pentane as co-solvents. The results were significantly better than with $CO_2$ alone, as the hexane/pentane were able to extract the longer chained hydrocarbons. From visual inspection of the residue, almost all of the bitumen and other hydrocarbons were stripped away from the clay substrate.

While the invention has been illustrated and described in detail in the drawings and foregoing description, the same is to be considered as illustrative and not restrictive in character, it being understood that only the preferred embodiments have been shown and described. The scope of the claims should not be limited by the preferred embodiments set forth in the examples, but should be given the broadest interpretation consistent with the description as a whole. In addition, all references cited herein are indicative of the level of skill in the art.

We claim:

1. A method for extracting hydrocarbons from a poor processing bitumen froth obtained from a non-traditional bitumen, solids and water slurry including oil sand tailings, fluid fine tailings and middlings, comprising:

subjecting the bitumen, solids and water slurry to flotation in a flotation device to produce the poor processing bitumen froth;

optionally subjecting the poor processing bitumen froth to centrifugation to remove a portion of the water from the poor processing bitumen froth; and subjecting the poor processing bitumen froth to supercritical extraction in a pressure vessel using a supercritical fluid to produce a hydrocarbon stream suitable for further upgrading.

2. The method of claim 1, wherein the supercritical fluid is selected from the group consisting of carbon dioxide ($CO_2$), propane, pentane, hexane, and combinations thereof.

3. The method of claim 2, wherein the supercritical fluid is pentane.

4. The method of claim 3, wherein the pressure vessel is pressurized to about 2000 psi to about 5000 psi and is operated at a temperature of about 120° C. or higher.

5. The method of claim 2, wherein the supercritical fluid is $CO_2$.

6. The method of claim 5, wherein the pressure vessel is pressurized to about 9000 psi and is operated at a temperature of about 100° C. or higher.

7. The method of claim 1, wherein the supercritical fluid is a combination of $CO_2$ and pentane or hexane.

8. The method of claim 1, wherein the poor processing bitumen froth comprises about 10-30 wt % bitumen, about 50-70 wt % water and about 20 wt % solids or more.

9. The method of claim 1, wherein the bitumen, solids and water slurry is oil sand tailings.

10. The method of claim 1, wherein the bitumen, solids and water slurry is fluid fine tailings.

11. The method of claim 1, wherein the bitumen, solids and water slurry is fluid fine tailings obtained from a tailings pond.

12. The method of claim 1, wherein the bitumen, solids and water slurry is a middlings stream obtained from a primary or secondary separation vessel.

* * * * *